US005845683A

United States Patent [19]

Sundby et al.

[11] Patent Number: 5,845,683

[45] Date of Patent: Dec. 8, 1998

[54] METHOD AND APPARATUS FOR CLEANING A FILL PIPE OF A LIQUID PACKAGING MACHINE

[75] Inventors: Paul Sundby, Mahtomedi; Don Haslach, Roseville, both of Minn.

[73] Assignee: Tetra Laval Holdings & Finance, SA, Pully, Switzerland

[21] Appl. No.: 828,307

[22] Filed: Mar. 28, 1997

[51] Int. Cl.[6] ..... B65B 3/04

[52] U.S. Cl. ..... 141/90; 141/91

[58] Field of Search ..... 141/89–91

[56] References Cited

U.S. PATENT DOCUMENTS

| | | | |
|---|---|---|---|
| 3,430,639 | 3/1969 | Roberts | 141/91 |
| 3,513,024 | 5/1970 | Culliton | 141/91 |
| 4,396,044 | 8/1983 | Ahlers | 141/90 |
| 4,527,377 | 7/1985 | Hayashi et al. | 141/91 |
| 4,534,494 | 8/1985 | Hautemont | 141/91 |
| 4,688,611 | 8/1987 | Yoshida | 141/91 |
| 5,095,958 | 3/1992 | Tincati | 141/91 |
| 5,531,253 | 7/1996 | Nishiyama et al. | 141/90 |

*Primary Examiner*—J. Casimer Jacyna
*Attorney, Agent, or Firm*—Michael A. Catania

[57] ABSTRACT

A system for facilitating a clean-in-place operation of a filling station of a packaging machine is set forth. The system comprises a fill pipe assembly having a discharge end through which the liquid product may flow into a container disposed therebelow during a production cycle of the machine. A clean-in-place manifold is provided and is adapted to engage and seal with the discharge end of the fill pipe during the clean-in-place operation. A lift mechanism is utilized in a dual function role. The lift mechanism is operated during a container-filling cycle to lift and lower a container toward and away from the discharge end of the fill pipe assembly for filling with product and is operated during the clean-in-place operation to engage the clean-in-place manifold and to secure the clean-in-place manifold in engagement with the discharge end of the fill pipe assembly.

4 Claims, 9 Drawing Sheets

METHOD AND APPARATUS FOR CLEANING A FILL PIPE OF A LIQUID PACKAGING MACHINE

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

Packaging of liquid foodstuffs and the like is most often done with the help of a modern packaging machine which, at a high rate of production, manufactures filled, sealed packages under hygienically acceptable production conditions. Such a packaging machine operates to form, fill and seal a container, such as a gable-top container, from a suitable material, usually plastic-coated paper. In the formation and filling of a gable-top container, flattened blanks are first erected to form open, tubular cartons of generally rectangular cross-section. The blanks are then transferred to a first forming station of the machine which closes and seals one end of each carton. Thereafter, the cartons are typically placed on a conveyor and carried to the filling station of the machine where the cartons are filled with the desired portions of liquid product.

The filling station usually comprises one or more fill pipe assemblies. Each fill pipe assembly is connected to receive product from a product supply tank through an intermediate metering pump. The metering pump is controlled to pump a predetermined volume of product through the fill pipe assembly and into the cartons advanced along a carton transport path immediately below the fill pipe assembly. From the filling station, the filled cartons are conveyed to a final forming station of the machine where the cartons, by means of forming and sealing mechanisms, are given a liquid-tight top closure. Thereafter, the cartons, in the form of finished consumer packages, are discharged from the machine for further distribution.

It is desirable to conduct the packaging operations under hygienic conditions, especially in the packaging of food products. Among other things, this means that machine parts which come into direct contact with the products should be isolated as fully as possible from non-sterile environments of the machine. More importantly, the components of the machine which come into contact with the liquid products must be capable of being cleaned to reduce, if not eliminate, the possibility of contaminating the product as it passes through the filling system and into the containers. One such machine component requiring special attention is the fill pipe assembly.

U.S. Pat. No. 4,964,444 illustrates one manner in which the in-place cleaning of a fill pipe may be accomplished. There, the product fill pipe of the fill pipe assembly is partially surrounded by a tubular casing. The tubular casing is shaped such that a free flow space is formed in the interstitial region between the fill pipe and the casing. The lower end of the casing which faces towards the opening of the fill pipe is cut obliquely to expose the product fill pipe from one direction of view. The casing is adapted so that it can be closed with the aid of a detachable, complimentarily-shaped lid element to form a circulation container which substantially encloses the product fill pipe during a clean-in-place cycle of the machine. During such a cycle, cleaning solution is passed through the product fill pipe and into the circulation container whereby both the interior and exterior of the product fill pipe are cleaned.

In addition to the device disclosed in the above-described patent, a variety of other apparatus have been directed to clean-in-place operations. Examples of such improvements may be found in the following U.S. Patents.

U.S. Pat. No. 4,964,444 Issued Oct. 23, 1990

U.S. Pat. No. 4,688,611 Issued Aug. 25, 1987

U.S. Pat. No. 4,593,730 Issued Jun. 10, 1986

U.S. Pat. No. 4,527,377 Issued Jul. 9, 1985

U.S. Pat. No. 4,396,044 Issued Aug. 2, 1983

U.S. Pat. No. 3,513,024 Issued May. 19, 1970

U.S. Pat. No. 4,218,265 Issued Aug. 19, 1980

U.S. Pat. No. 3,430,639 Issued Mar. 4, 1969

Notwithstanding the foregoing, the present inventors have recognized that the standard process of altering a filling system configuration between a production cycle and a clean-in-place cycle is relatively laborious and time-consuming. As the present inventors have recognized, this is due, at least in part, to the extensive steps required to attach and detach a cleaning apparatus/system to a fill pipe assemble. Accordingly, the present inventors have set forth herein an apparatus that facilitates quick and easy configuration of the fill station of the packaging machine between a production cycle and a clean-in-place cycle of the machine.

BRIEF SUMMARY OF THE INVENTION

A system for facilitating a clean-in-place operation of a filling station of a packaging machine is set forth. The system comprises a fill pipe assembly having a discharge end through which the liquid product may flow into a container disposed therebelow during a production cycle of the machine. A clean-in-place manifold is provided and is adapted to engage and seal with the discharge end of the fill pipe during the clean-in-place operation. A lift mechanism is utilized in a dual function role. The lift mechanism is operated during a container-filling cycle to lift and lower a container toward and away from the discharge end of the fill pipe assembly for filling with product and is operated during the clean-in-place operation to engage the clean-in-place manifold and to secure the clean-in-place manifold in engagement with the discharge end of the fill pipe assembly.

The manifold may include an input port into which a discharge end of a fill pipe may be inserted for a clean-in-place operation. The manifold may further include an output port for attachment to a fluid-conducting outlet pipe that extends between the manifold and, for example, a recirculation input or a drain.

The input port of the manifold is preferably provided with an inner-circumferential surface having a groove into which a flexible sealing gasket is secured. The physical characteristics of this sealing gasket are such that it is placed in leak proof engagement with an exterior surface of the discharge end of the fill pipe as such discharge end is inserted into the input port of the manifold. The sealing gasket is preferably designed to withstand any increased pressure which is placed upon it during a clean-in-place operation and, even more preferably, serves to provide a stronger seal with the fill pipe under such conditions.

The manifold also includes an inverted, cup-shaped seat mounted on its underside. This seat is designed for complementary engagement with the container lift rod of the lift mechanism. This lift rod engages the seat and preferably functions to lift, and maintain, the manifold into the proper operational position for a clean-in-place operation.

In a preferred method of operation, the clean-in-place manifold is positioned beneath the discharge end of the fill pipe assembly so that the lift rod engages the seat of the manifold. The lift rod is operated to move vertically a predetermined distance to urge the inlet port of the manifold into secured and sealed engagement with the discharge end of the fill pipe. The lift rod of the lift mechanism maintains the manifold in such engagement throughout the clean-in-place cycle of operation of the machine. As will suggest itself, no additional tools, clamps, or other mechanical means are necessary to secure the clean-in-place manifold to the fill pipe during the clean-in-place operation, although such mechanical securements are not necessarily precluded.

DETAILED DESCRIPTION OF THE INVENTION

Figure 1:
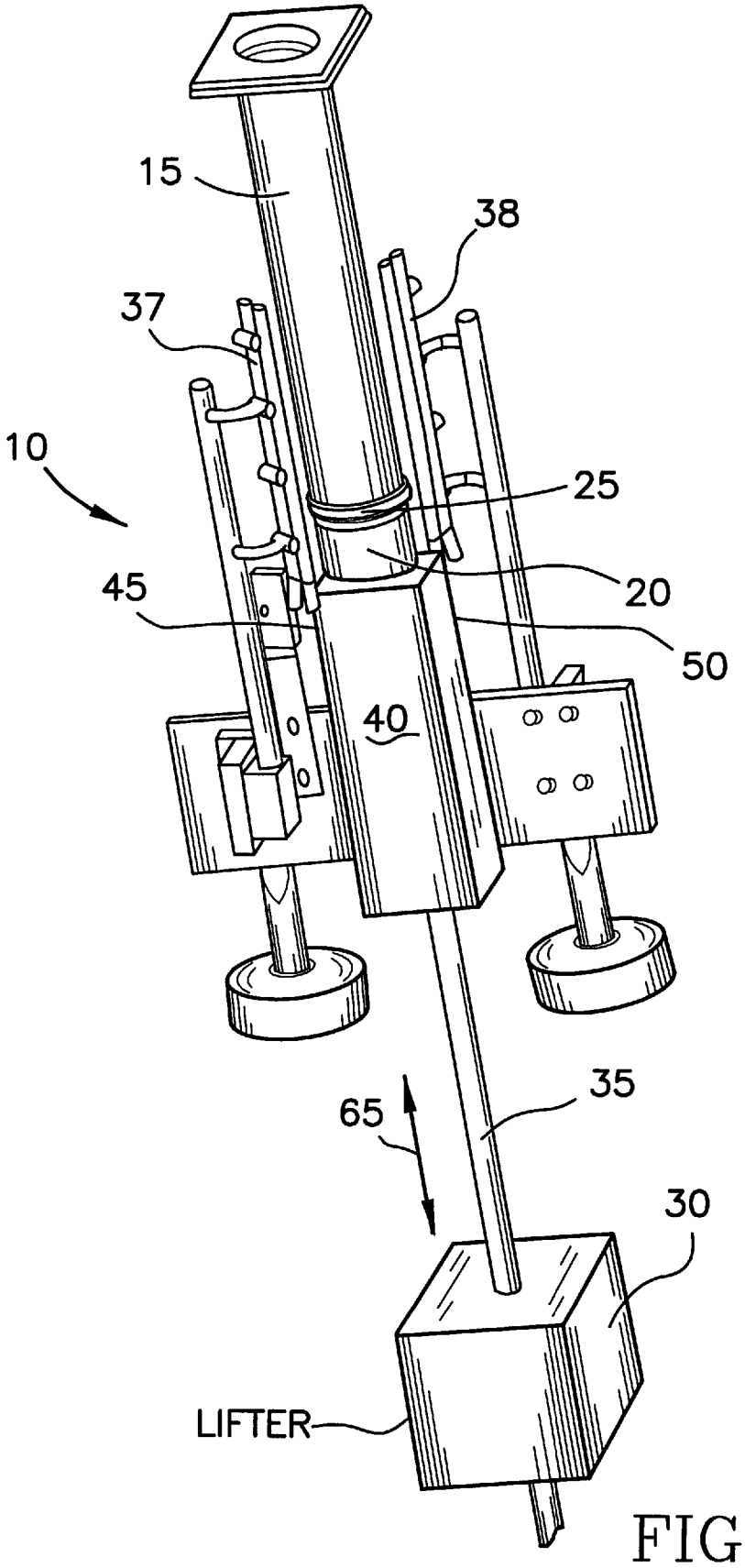
FIG. 1 is a perspective view of one embodiment of a filling system of the present invention during a production cycle of operation of the packaging machine.

Referring to FIG. 1, one embodiment of a filling assembly 10 of a packaging machine is shown operating in a production cycle. The filling assembly includes a fill pipe 15 having a discharge end 20 that, depending on the type of filling system and nature of the dispensed product, may have a flexible, pressure-actuated nozzle disposed thereover. A radially extending collar 25, formed either integral with the fill pipe 15 or as a separate piece that joins the body of the fill pipe to the discharge end 20, is disposed proximate the discharge end 20. A lift mechanism 30 having, for example, a lift rod 35 for engaging a container is disposed below the discharge end 20 of the fill pipe 15. Such system may also advantageously incorporate the use of external container guides 37 and 38.

In accordance with a production cycle of the packaging machine, a container 40 (typically one of a plurality of containers on container supports disposed on an endless conveyor belt) is engaged on its underside by the lift rod 35 of the lift mechanism 30 and is driven vertically so that the container 40 is placed proximate the discharge end 20 of the fill pipe 15 so that the container 40 may receive the desired product from fill pipe 15. As container 40 is being raised into the proper filling position, corners 45 and 50 of the container are securely received between respective parallel rails of the external container guides 37 and 38 to ensure that container 40 maintains a proper shape and orientation during the filling process. Thus, the container 40 remains properly aligned with the discharge end 20 of the fill pipe 15 even when it is raised above the supports of the endless belt conveyor As product is being discharged into the container 40, the lift mechanism 30 lowers the container 40 in accordance with a predetermined motion profile until it is again disposed in the carton supports of the endless belt conveyor (not illustrated). Preferably, particularly in instances in which a liquid product is discharged into the container 40, the lift mechanism 30 lowers the container 40 so as to maintain the nozzle (not illustrated) that is disposed at the discharge end 20 below the level of the liquid in the container 40. The vertical movement described is shown generally at 65.

Figure 2:
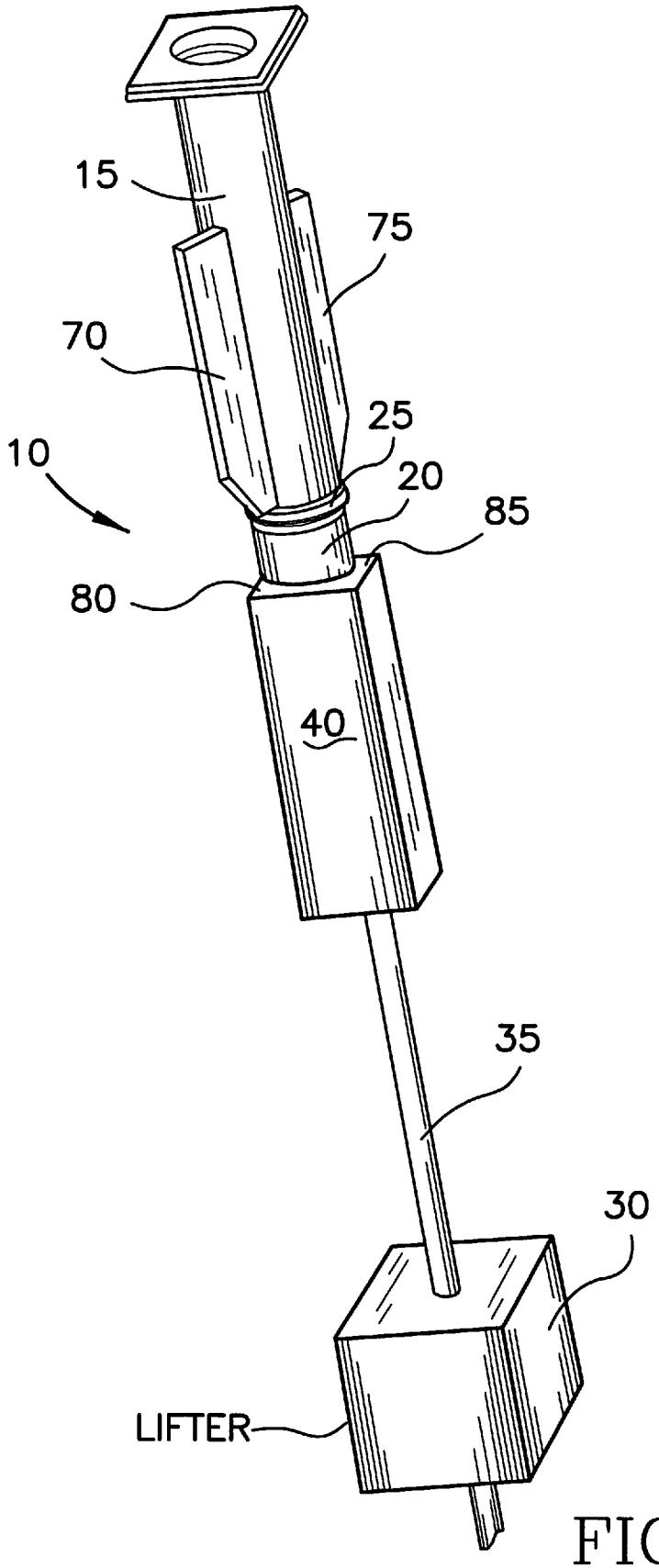
FIG. 2 is a perspective view of a further embodiment of a filling system of the present invention during a production cycle of operation of the packaging machine.

FIG. 2 shows another embodiment of a filling assembly 10 of a packaging machine. The filling assembly shown here is similar to the embodiment described in connection with FIG. 1. This filling assembly 10, however, includes internal container guides 70 and 75 mounted upon fill pipe 15 so as to engage internal diagonal comers of the container 40 as it is raise and lowered to and from the discharge end 20 of the fill pipe 15 during the production cycle. With reference to FIG. 2, internal container guides 70 and 75 serve to engage, and securely position, the internal surfaces of comers 80 and 85 of container 40. Such practice again ensures that container 40 remains in the proper shape and orientation throughout the filling operation.

Figure 3:
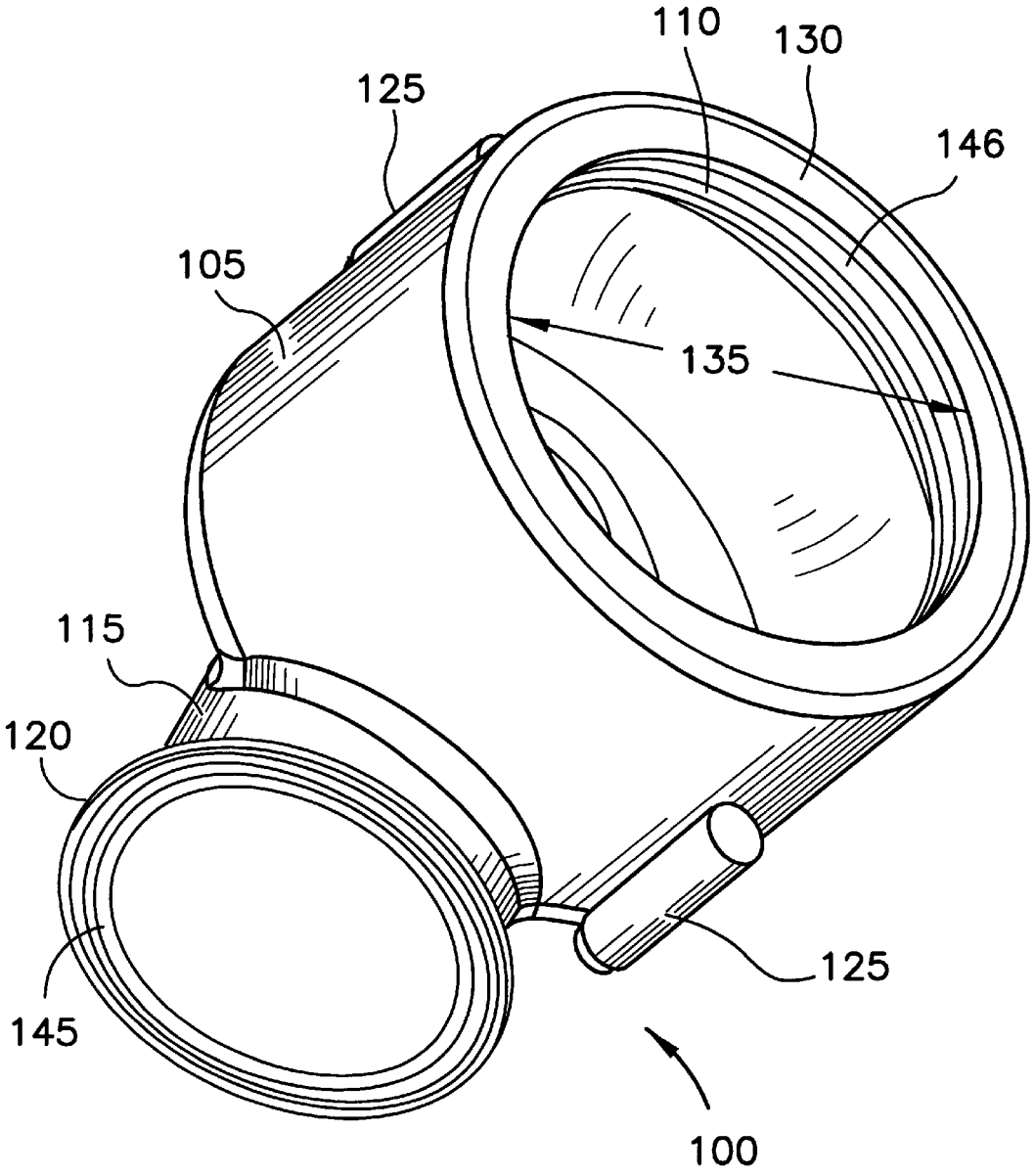
FIG. 3 is a perspective view of one embodiments of a clean-in-place manifold of the present invention that may be used with the embodiments of the filling systems of FIGS. 1 and 2 during a clean-in-place cycle of operation of the packaging machine.
Figure 4:
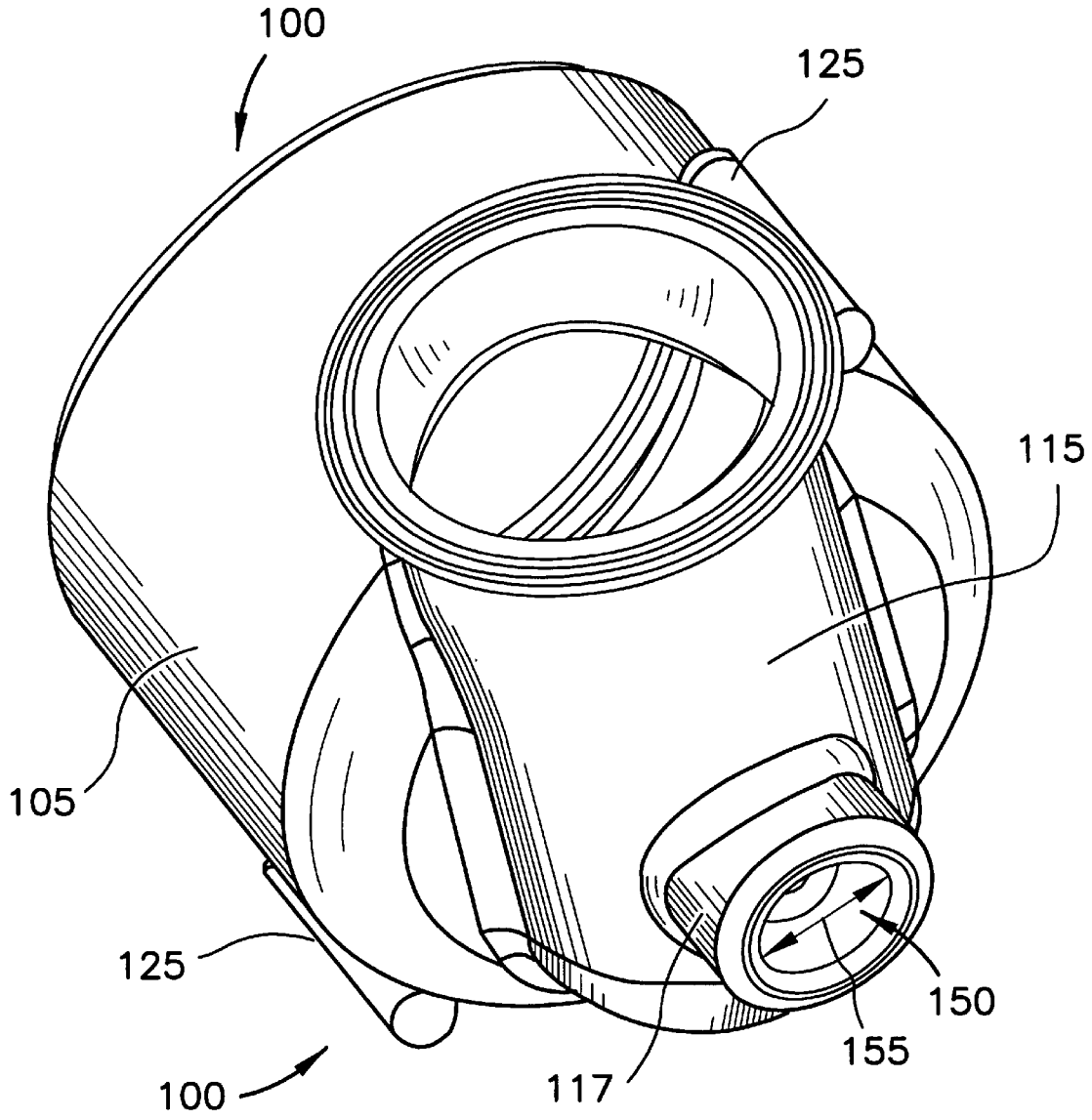
FIG. 4 is a further perspective view of the embodiment of the clean-in-place manifold of FIG. 3.

Turning now to FIGS. 3 and 4, one embodiment of a clean-in-place manifold 100 is shown. The manifold includes a body portion 105 having an inlet port, shown generally at 110, an outlet port shown generally at 115, and a rod seat shown generally at 117. If the external carton guides 55 and 60 of the system of FIG. 1 are used, the body portion 105 is preferably provided with an optional pair of guide pins 125.

Inlet port 110 comprises a lip portion 130 that has an inside diameter 135 which is dimensioned to receive the discharge end 20 of the fill pipe 15 therein. The inlet port 110 further includes a sealing gasket 140 which, as will be discussed in further detail below, is secured within the inlet port 110 to seal with collar 25 of the fill pipe 15.

The outlet port 115 includes an integrally-formed flange member 120 that, for example, is dimensioned to engage a corresponding flange of a further pipe at a tri-clamp connection. Accordingly, the outlet port 115 may be provided with a groove 145 in the flange member 120 which is dimensioned and shaped to engage a corresponding gasket or O-ring to provide a seal with the further pipe. Such a further pipe may extend between the manifold 100 and, for example, a recirculation input or a drain of the packaging machine.

With reference to FIG. 4, the rod seat 117 of the illustrated embodiment is shown as a structure that is disposed at the bottom of manifold 100. Seat 117 of the embodiment has an inverted, cup-shape which defines a seat cavity 150 having an interior diameter 155 which is dimensioned to engage the lift rod 35, or other lifting member, of the lift mechanism 30. It will be recognized, however, that the seat 117 may take on any number of shapes, the particular shape being dependent on the type and shape of the engagement member of the left mechanism 35 that is used.

Operation of the filling system 10 of the embodiment of FIG. 1 pursuant to a clean-in-place cycle of the machine can be described in connection with FIGS. 5 and 6. As illustrated, the preferred embodiment of the clean-in-place manifold 100 is initially positioned, either manually or automatically, immediately beneath the discharge end 20 of fill pipe 15 in preparation for a clean-in-place operation. In this position, the rod 35 of the lift mechanism 30 preferably is seated within the rod seat 117. Additionally, when the manifold 100 is in this position, guide pins 125 are aligned with the regions between the rails of the external container guides 37 and 38.

Figure 5:
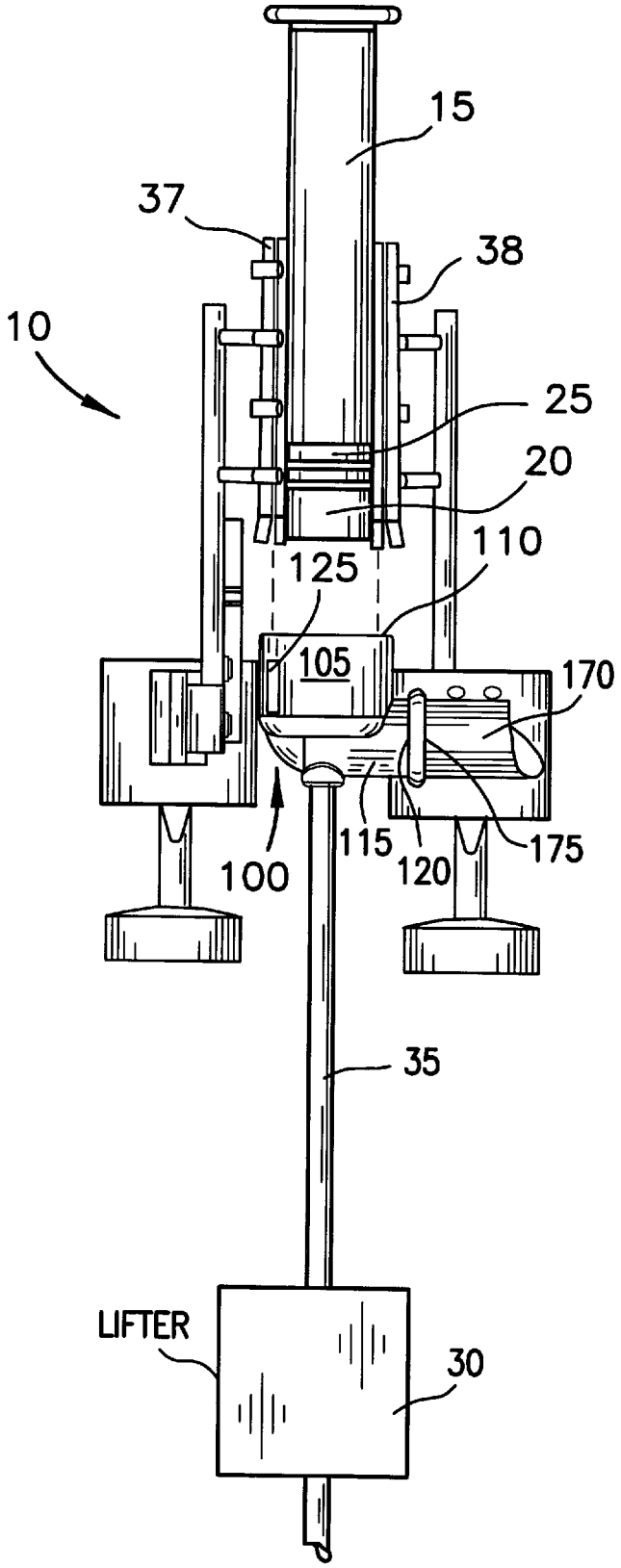
FIG. 5 is a side view of the filling system of FIG. 1 wherein the clean-in-place manifold is engaged by a lift member of the lifting mechanism and disposed below a fill pipe prior to operational engagement therewith.
Figure 6:
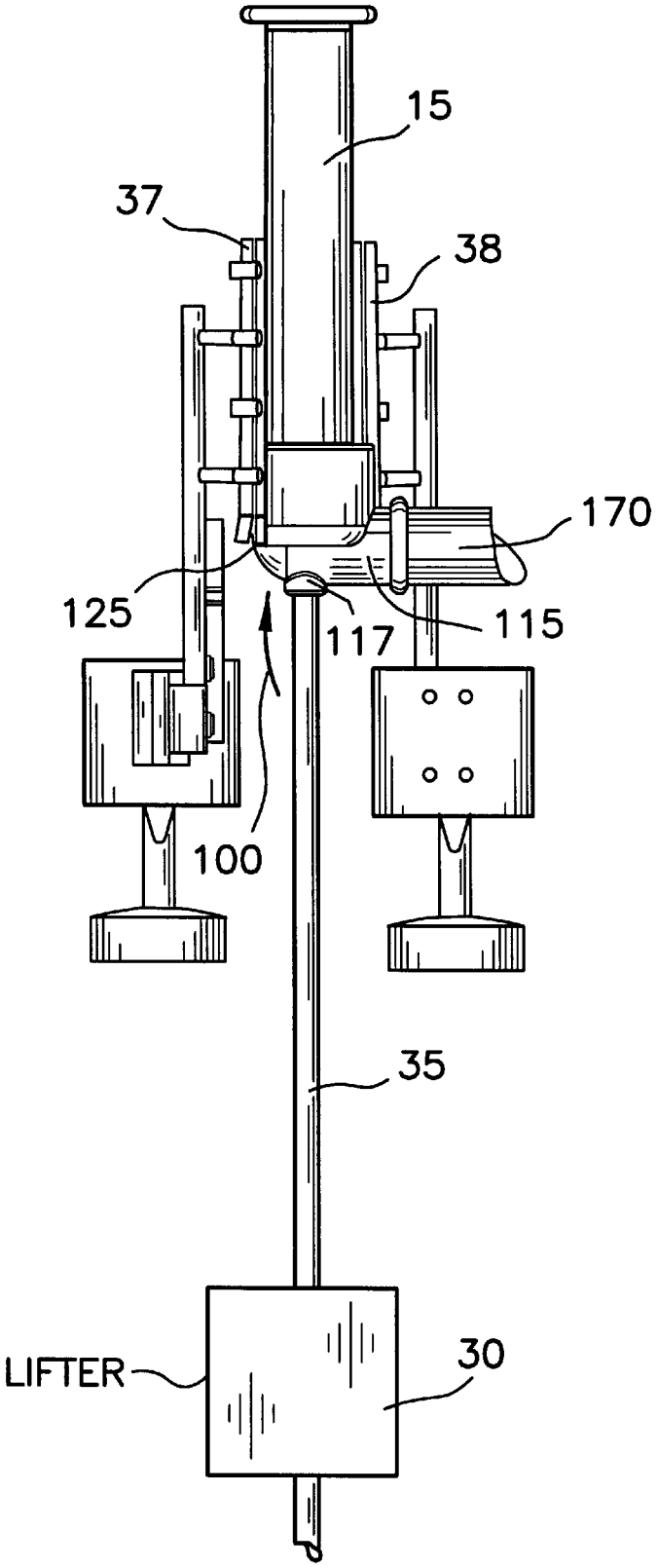
FIG. 6 is a side view of the filling system of FIG. 5 wherein the clean-in-place manifold is in operational engagement with the fill pipe, the clean-in-place manifold being supported in place by a lift rod of a liquid packaging machine.

Once in the position illustrated in FIG. 5, the lift mechanism 30 is operated to drive the lift rod 35 and the manifold 100 to the position illustrated in FIG. 6. Such actuation may be accomplished, for example, through depression of a key or other form of switch by the machine operator, or in an automatic timed relationship with the initial positioning of the manifold 100 in the position of FIG. 5. In the position of FIG. 6, the collar 25 at the discharge end 20 of the fill pipe 15 is disposed within the inlet port 110 of the manifold 100 and seals therewith. Additionally, the guide pins 125 are disposed between respective rails of the external container guides 37 and 38. Once in this position, the fill system 10 is mechanically ready to undergo a clean-in-place operation. During a clean-in-place cycle of the packaging machine, the lift mechanism 35 is used to maintain the manifold 100 in the illustrated position.

The embodiment shown in FIG. 5 also illustrates the engagement between the outlet port 115 and a corresponding pipe 170. Specifically, flange member 120 is formed to readily connect to another similarly-formed flange member 175 of pipe 170. Securement between flange member 120 and flange member 175 may be accomplished in any number of known ways, including tri-clamps, bolts, etc..

Figure 8:
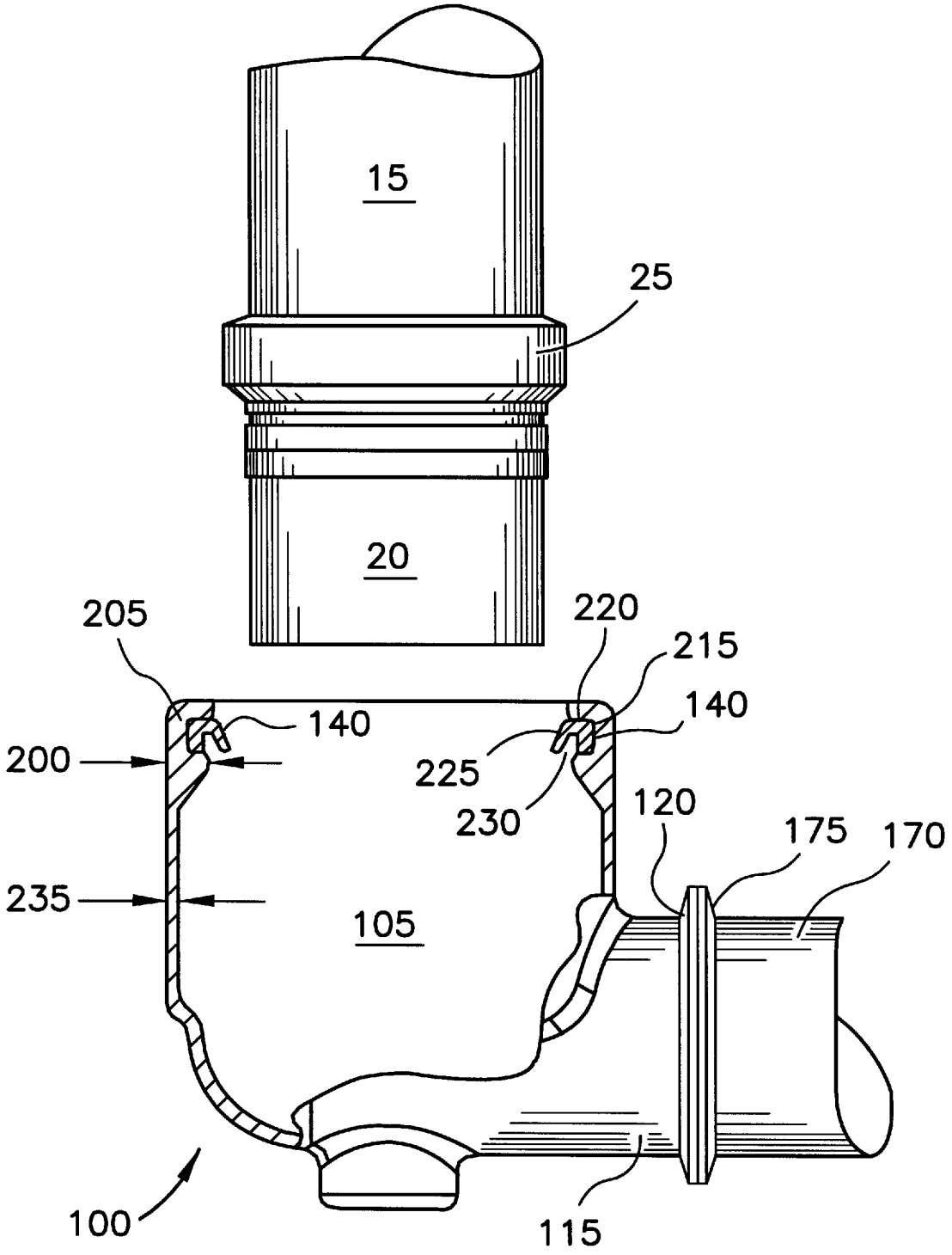
FIG. 8 is a side cross-sectional view of the clean-in-place manifold and the associated fill pipe.
Figure 9:
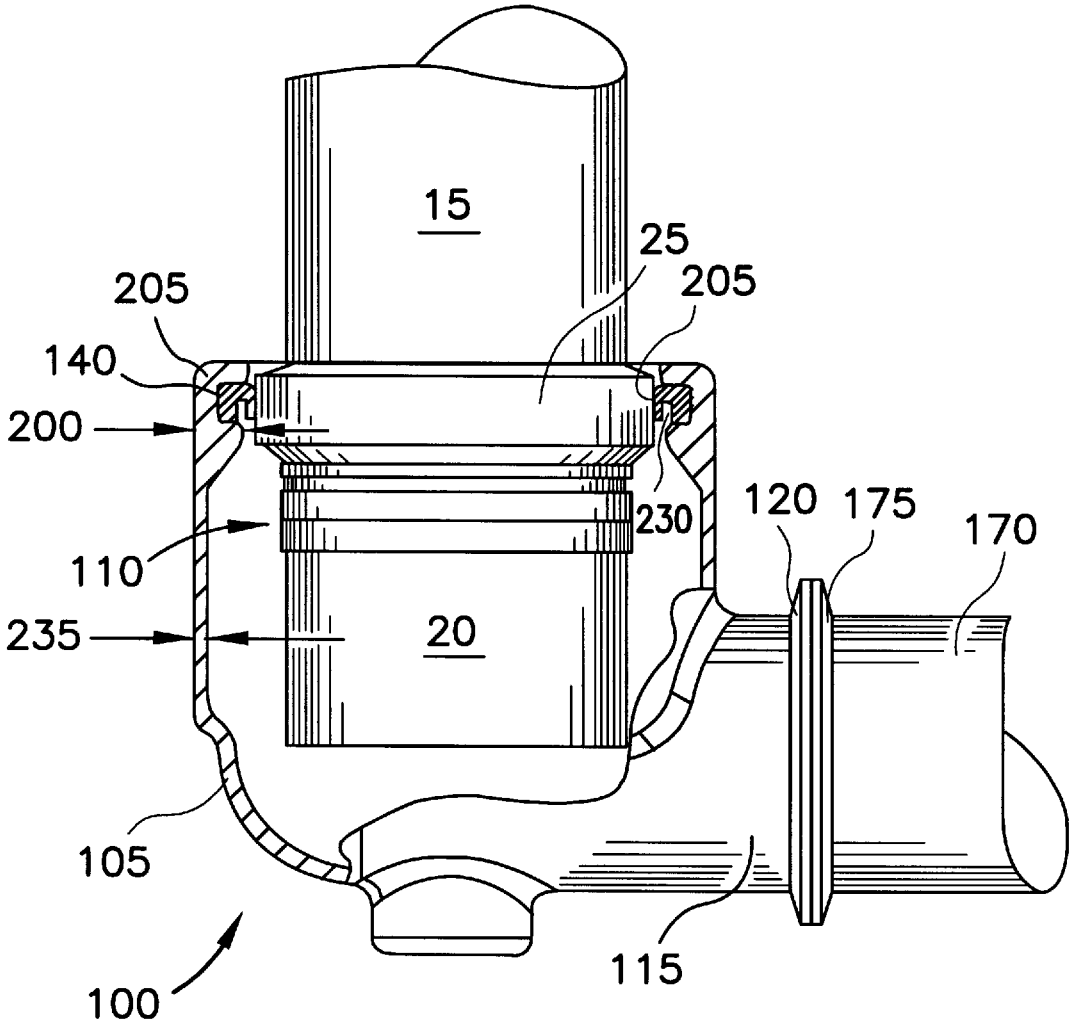
FIG. 9 is a side cross-sectional view of the clean-in-place manifold having the associated liquid fill pipe inserted therein for a clean-in-place cycle of machine operation.

FIGS. 8 and 9 illustrate one manner of engagement between the discharge end 20 of the fill pipe 15 and the inlet port 110 of the manifold 100, with FIG. 8 illustrating the system prior to engagement between the discharge end 20 and the inlet port 110 and FIG. 9 illustrating the system as fully engaged. As illustrated, inlet port 110 is defined by a wall having a thickness 200 sufficiently thick so as to have a groove 205 formed therein. Groove 205 is dimensioned to serves as a receptacle into which the sealing gasket 140 is secured. Sealing gasket 140 has an inverted U-shaped cross-section comprising a rear edge 215, a top edge 220 and a sealing edge 225. Such U-shape also results in the formation of a pocket area 230 on the underside of sealing gasket 140. As may be observed in FIG. 8, rear edge 215 and top edge 220 of sealing gasket 140 are mounted within groove 205 whereas sealing edge 225 extends inwardly and downwardly therefrom.

With reference to FIG. 9, as manifold 100 is raised so as to allow discharge end 20 and collar 25 to pass through inlet port 110 into the interior of body portion 105, sealing edge 225 of sealing gasket 140 is compressed into liquid-tight engagement with a circumferential exterior surface of collar 25. Given that the manifold 100 is maintained in this position throughout the clean-in-place cycle via the lift rod 35, no additional mechanical components and no other tools are required to further secure the manifold 100 with the discharge end 20 of the fill pipe 15.

The body thickness 235 of body portion 105 is thinner than wall thickness 200 of inlet port 110. This decrease in thickness corresponds to an increased internal flow region 240. Such space allows discharge end 20 to have the maximum exposure to cleaning fluids coming to/from fill pipe 15 and pipe 170 during a clean-in-place operation.

A clean-in-place operation may be accompanied by increased fluid pressure within the body portion 105 of manifold 100. The pocket area 230 of the sealing gasket 140 of the preferred embodiment accepts fluid at this increased pressure therein whereby an additional force on sealing edge 225 results in an even stronger seal between sealing edge 140 and the circumferential surface of collar 25. After the clean-in-place operation is completed, pressure within the body 105 is reduced to a normal level. Thereafter, the lift mechanism 35 is operated to lower the lift rod 35 and manifold 100 to facilitate removal of the manifold 100 to place the machine in a mechanical state suitable for a production cycle of machine operation.

Figure 7:
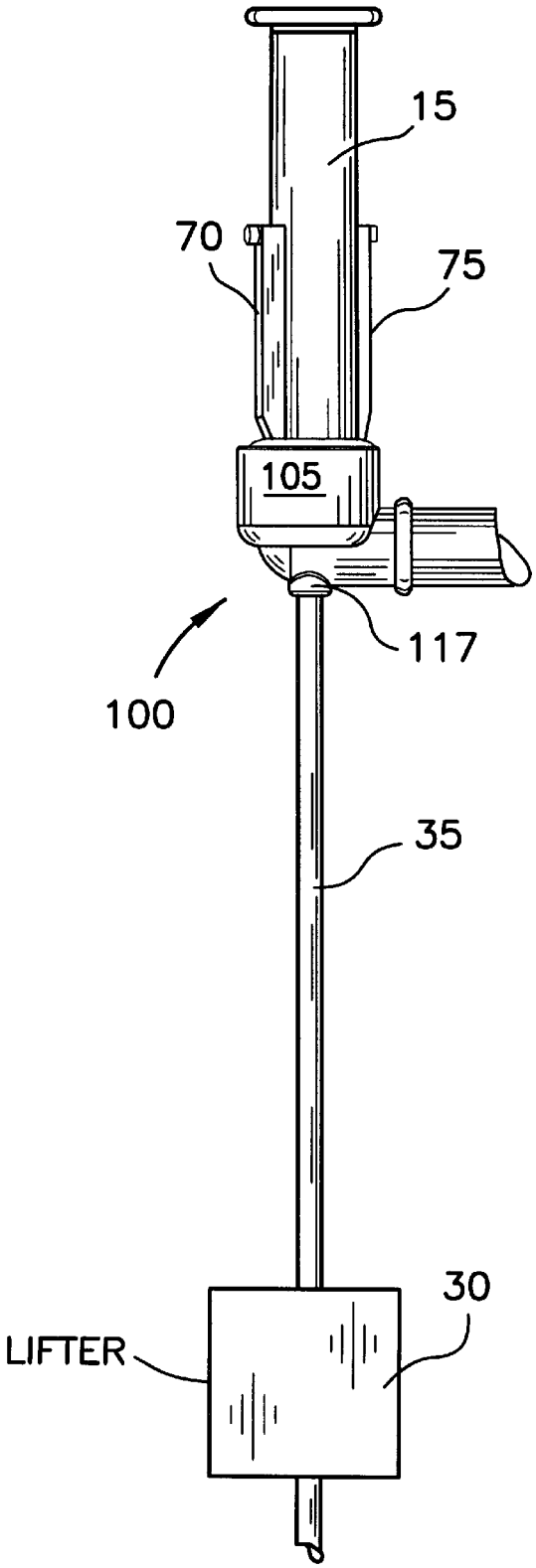
FIG. 7 is a side view of the clean-in-place manifold in operational engagement with a fill pipe assembly such as the one set forth in FIG. 2.

FIG. 7 illustrates engagement between the manifold 100 and the filling system of FIG. 2. As shown, the manifold 100 is not provided with the guide pins 125 since the fill pipe 15 is instead provided with internal container guides 70 and 75. However, the internal container guides 70 and 75 are tapered proximate the discharge end 20 of the fill pipe 15 so that they do not interfere with the proper engagement between the discharge end 20 and the inlet port 110 of the manifold 100.

Although not particularly pertinent to the claimed invention, it is worth noting, with reference to FIGS. 5, 6 and 7, that the lift rod 35 may extend through a bushing not shown disposed in a table not shown of the packaging machine. Preferably, the bushing is supplied with a flow of cleaning/lubricating fluid. Such a bushing is disclosed in co-pending U.S. patent application Ser. No. 08/825,207, filed on Mar. 28, 1997, entitled Improved Seal For A Reciprocating Rod Of A Packaging Machine.

Although the present invention has been described with reference to a specific embodiment, those of skill in the art will recognize that changes may be made thereto without departing from the scope and spirit of the invention as set forth in the appended claims.

We claim:

1. In a machine for filling a container with a liquid product, a system for facilitating a clean-in-place operation, the system comprising:

a fill pipe assembly having a discharge end through which the liquid product may flow into a container disposed therebelow;

a lift mechanism that is operated during a container-filling cycle to lift and lower a container toward and away from the discharge end of the fill pipe assembly and that is further operated during the clean-in-place operation to engage the clean-in-place manifold and to secure the clean-in-place manifold in engagement with the discharge end of the fill pipe assembly and clean-in-place manifold adapted to engage and seal with the discharge end of the fill pipe during the clean-in-place operation, the clean-in-place manifold comprising a lift seat for complimentary engagement with the lift mechanism during the clean-in-place operation, the lift seat substantially cup-shaped and invertedly mounted on an underside of the manifold, an interior portion of the lift seat accommodating the lift mechanism for complimentary engagement therewith during the clean-in-place operation, an integrally-formed inlet port into which the discharge end of the fill pipe assembly is inserted, a sealing gasket secured within the inlet port, the sealing gasket forming a fluid-tight seal with an outer surface of the discharge end of the fill pipe assembly as the discharge end is inserted into the inlet port, the sealing gasket formed of a flexible material and at least a portion of the sealing gasket exposed to an interior area of the manifold once the discharge end of the fill pipe assembly is inserted into the inlet port, the sealing gasket providing a strong seal with the outer surface of the discharge end of the fill pipe assembly as increased pressure created within the clean-in-place manifold is placed upon the sealing gasket during the clean-in-place operation.

2. The system of claim 1, wherein the clean-in-place manifold further includes at least one integrally-formed outlet port connectable to a fluid-conducting conduit to allow complete fluid communication between the conduit and the discharge end of the fill pipe assembly through the clean-in-place manifold.

3. In a machine for filling a container with a liquid product, the machine having a fill pipe assembly with a discharge end through which the liquid product may flow into a container disposed therebelow, an apparatus for facilitating a clean-in-place operation, the apparatus comprising:

a body;

an inlet port integrally-formed with the body, the inlet port adapted to engage and seal with the discharge end of the fill pipe assembly during the clean-in-place operation;

a sealing gasket secured within the inlet port, the sealing gasket forming a fluid-tight seal with an outer surface of the discharge end of the fill pipe assembly as the discharge end is inserted into the inlet port, the sealing gasket formed of a flexible material and at least a portion of the sealing gasket exposed to an interior area of the manifold once the discharge end of the fill pipe assembly is inserted into the inlet port, the sealing gasket providing a strong seal with the outer surface of the discharge end of the fill pipe assembly as increased pressure created within the clean-in-place manifold is placed upon the sealing gasket during the clean-in-place operation;

at least one outlet port integrally-formed with the body, the outlet port adapted to connect to a fluid-conducting conduit to allow complete fluid communication between the conduit and the discharge end of the fill pipe assembly through the body; and a lift seat secured to the body, wherein a lift mechanism that is normally operated during a container-filling cycle to lift and lower a container toward and away from the discharge end of the fill pipe assembly is further operated during the clean-in-place operation to engage the lift seat of the apparatus and to secure the inlet port in engagement with the discharge end of the fill pipe assembly, wherein the lift seat is substantially cup-shaped and invertedly mounted on an underside of the body, an interior portion of the lift seat accommodating the lift mechanism for complimentary engagement therewith during the clean-in-place operation.

4. In a machine for filling a container with a liquid product, a method of cleaning a liquid dispensing fill pipe assembly, the method comprising the steps of:

providing a clean-in-place manifold having an inlet port and at least one outlet port connectable to a fluid-conducting conduit, a sealing gasket formed of a flexible material and secured within the inlet port, and a lift seat on the clean-in-place manifold for engagement with a lift mechanism of the container-filling machine wherein the lift seat is substantially cup-shaped and invertedly mounted on an underside of the manifold, an interior portion of the lift seat accommodating the lift mechanism for complimentary engagement therewith during the cleaning process;

positioning the inlet port in concentric relation below a discharge end of the fill pipe assembly;

lifting the manifold by the lift mechanism so as to insert the discharge end of the fill pipe assembly into the inlet port wherein the sealing gasket forms a fluid-tight seal with an outer surface of the discharge end of the fill pipe assembly as the discharge end is inserted into the inlet port, at least a portion of the sealing gasket exposed to an interior area of the manifold once the discharge end of the fill pipe assembly is inserted into the inlet port, the sealing gasket providing a strong seal with the outer surface of the discharge end of the fill pipe assembly as increased pressure created within the clean-in-place manifold is placed upon the sealing gasket during the cleaning process;

supporting the manifold by the lift mechanism in a position to maintain the fluid-tight seal throughout a cleaning process without further securing the manifold to the fill pipe assembly or any other stationary structure; and initiating a clean-in-place operation wherein complete fluid communication is allowed between the fill pipe assembly and the conduit through the manifold.

* * * * *